US006079347A

United States Patent [19]

Lieb

[11] Patent Number: 6,079,347

[45] Date of Patent: Jun. 27, 2000

[54] TOMBSTONE MOUNTED, TORPEDO TUBE FLOW CONTROL VALVES

[75] Inventor: George W. Lieb, North Kingstown, R.I.

[73] Assignee: The United States of America as represented by the Secretary of the Navy, Washington, D.C.

[21] Appl. No.: 09/120,873

[22] Filed: Jul. 14, 1998

[51] Int. Cl.[7] ..... F41F 3/10

[52] U.S. Cl. ..... 114/238

[58] Field of Search ..... 114/238, 319, 114/239; 89/1.81, 5; 251/145

[56] References Cited

U.S. PATENT DOCUMENTS

| | | | |
|---|---|---|---|
| 5,210,369 | 5/1993 | Cassidy | 89/1.81 |
| 5,375,502 | 12/1994 | Bitsakis | 89/1.81 |
| 5,421,244 | 6/1995 | Hubbell | 92/181 P |
| 5,438,945 | 8/1995 | Moody | 114/238 |
| 5,438,948 | 8/1995 | Moody | 114/319 |
| 5,448,962 | 9/1995 | Moody | 114/238 |

FOREIGN PATENT DOCUMENTS

| | | | |
|---|---|---|---|
| 403158 | 5/1923 | Austria | 114/238 |

*Primary Examiner*—Jack W. Lavinder
*Attorney, Agent, or Firm*—Michael J. McGowan; James M. Kasischke; Prithvi C. Lall

[57] ABSTRACT

A tombstone assembly within a vessel utilizes disk control valves for controlling the flow of seawater to torpedo tubes. The disk control valves have disks abutting flow ports on a vertical plate within a tombstone. The vertical plate separates an impulse chamber from a plurality of tube chambers. The tube chambers hold the torpedo tubes. The disks control the flow of seawater between the impulse chamber and the tube chambers. The seawater is initially pumped from outside the vessel through a water cylinder into a lower impulse tank then into the impulse chamber of the tombstone. The disk valves then control the flow of the seawater to the tube chambers.

11 Claims, 4 Drawing Sheets

TOMBSTONE MOUNTED, TORPEDO TUBE FLOW CONTROL VALVES

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention generally relates to the control of the flow of water to torpedo tubes. More particularly the invention provides a new tombstone and the use of disk valves to control the flow of seawater to the torpedo tubes.

(2) Description of the Prior Art

U.S. Naval Submarines are typically equipped with either four or eight torpedo tubes. These torpedo tubes are normally divided evenly into a port and starboard bank of tubes that operate independently of each other.

In operation seawater is initially drawn from outside the hull, through a water cylinder, and into a pump inlet. The inlet's pump is typically either an air powered turbine or a ram pump. The seawater passes through the pump and discharges into a large tank, named the lower impulse tank. The water then exits from the lower impulse tank through a water passage aperture into a smaller tank mounted on top of the lower impulse tank. This smaller tank is referred to as either an upper impulse tank or a tombstone. In this application it is primarily referred to as a tombstone.

The tombstone is a rectangular tank with apertures bored on two opposing sides for each torpedo tube. Each torpedo tube is inserted through a pair of opposed apertures in the tombstone and then welded to the tombstone. Each bank of torpedo tubes share a common tombstone. Rectangular slots are machined into each of the torpedo tubes circumferential walls within the volume bound by the tombstone's walls. These slots allow for the flow of water from the tombstone into the torpedo tube to provide an impulse to eject a vehicle housed within the torpedo tube.

An isolation valve isolates the interior of each torpedo tube from the tombstone allowing the torpedo tube to be free of seawater. To prevent simultaneous weapon ejection, a launch control system allows only one isolation valve to be open at a time. Past U.S. Submarines have always used a tube enclosed slide valve. A slide valve is comprised of a cylinder, gaskets, and actuators. The cylinder, which is slightly smaller than the torpedo tube, is inserted into the aft end of the torpedo tube. The slide valve is positioned to cover the slots that have been machined into the tube. On both ends of the cylinder are gaskets that prevent sea water from seeping between the torpedo tube inner diameter and the cylinder outer diameter. Actuators are mounted on the tube outer diameter to provide power to the cylinder to expose the slots.

There are disadvantages to the use of a slide valve on a submarine. One is that in order to maintain an adequate seal between the slide valve cylinder and the torpedo tube, tolerances of ±0.005" are required on the torpedo tube inner diameter and the cylinder outer diameter. This machining operation is performed after the torpedo tube is welded into the submarine. The setup time and portable boring bar operation required to perform this operation in the submarine is both complex and time consuming.

Another disadvantage is that contaminated water flowing through the launch system is known to damage the slide valve gaskets. The water may contain sand, flakes of rust, dirt, paint chips and other foreign matter. These items are often entrapped between the slide valve gaskets and tube as the cylinder slides fore and aft. Cuts in the gasket often occur on the bottom of the tube from particles that settle when the launch system is not in use. Gaskets are frequently replaced due to cuts and excessive wearing. This is a time consuming process.

Arranging the actuators on the torpedo tube has often been a problem. The actuators are mounted on the torpedo tube outside diameter either forward or aft of the tombstone. Mounting aft of the tombstone extends the torpedo tube into the torpedo room. Mounting the actuators forward of the tombstone can result in an interference with the pressure hull.

A goal of any launch system is to reduce the level of noise generated from the flow of water through the system. Known methods to lower this level are to reduce the water velocity through the system and eliminate obstructions. The flow slots in the torpedo tube have been identified as a large contributor since they are an obstruction at a location of accelerating and turning flow. Numerous studies of this region have been conducted in an attempt to optimize the slot geometry to reduce the noise. There is general agreement that if the slots could be eliminated or increased in size then the noise generated would be reduced. Unfortunately, with the current ship designs, the slots cannot be eliminated since the remaining ligaments are a structural element of the tombstone and guide the slide valve cylinder.

SUMMARY OF THE INVENTION

Accordingly, it is a general purpose and object of the present invention to provide an improved tombstone.

It is a further object to eliminate the slide valve used in the torpedo tube as it has been identified as a large contributor to the level of noise generated from the flow of water through the system.

It is a further object that the system be compatible for use with state-of-the-art components in U.S. Navy vessels.

These objects are accomplished with the present invention by providing a tombstone having a rectangular block shape. A vertical plate divides the interior of the tombstone. The torpedo tubes are placed in a row with one atop another within the tombstone and, in one embodiment, each torpedo tube passes through apertures on opposite walls of the tombstone. In another embodiment, each torpedo tube passes through a single aperture. A horizontal plate is used to separate each tube from its adjacent tube.

The vertical plate has an aperture next to each torpedo tube for the passage of water from one side of the tombstone through the vertical plate to the side housing the torpedo tube. There are a plurality of disk valves with each disk controlling the flow of water from the inlet side of the tombstone to a torpedo tube chamber. A water passage aperture supplies water from the lower impulse tank to the inlet side of the tombstone.

BRIEF DESCRIPTION OF THE DRAWINGS

For a more complete understanding of the present invention and the advantages thereof, reference is now made to the following description of the preferred embodiment taken in conjunction with the accompanying drawings in which.

DESCRIPTION OF THE PREFERRED EMBODIMENT

Figure 1:
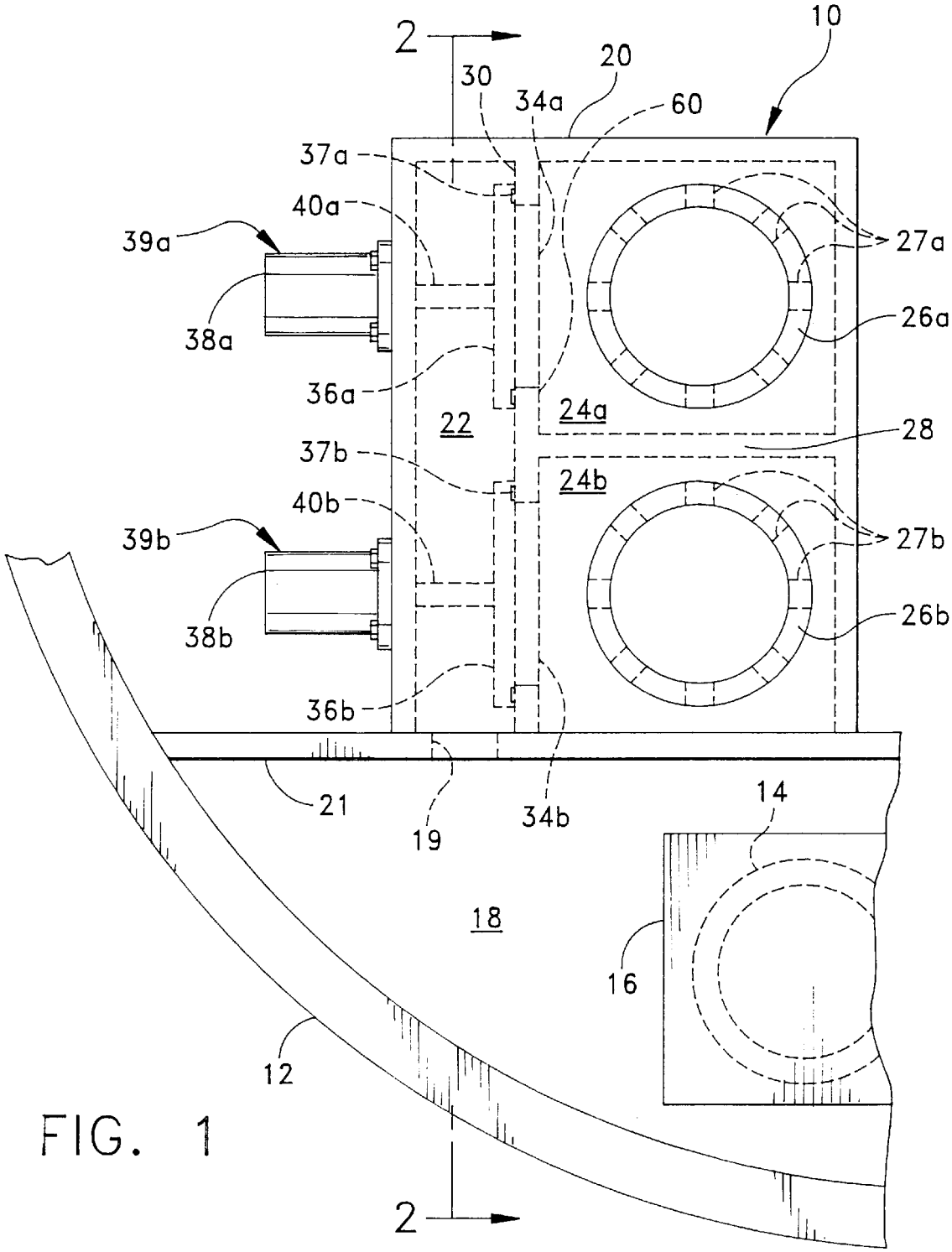
FIG. 1 is a view within the hull of a submarine showing an embodiment of the inventive tombstone assembly and its associated components.
Figure 2:
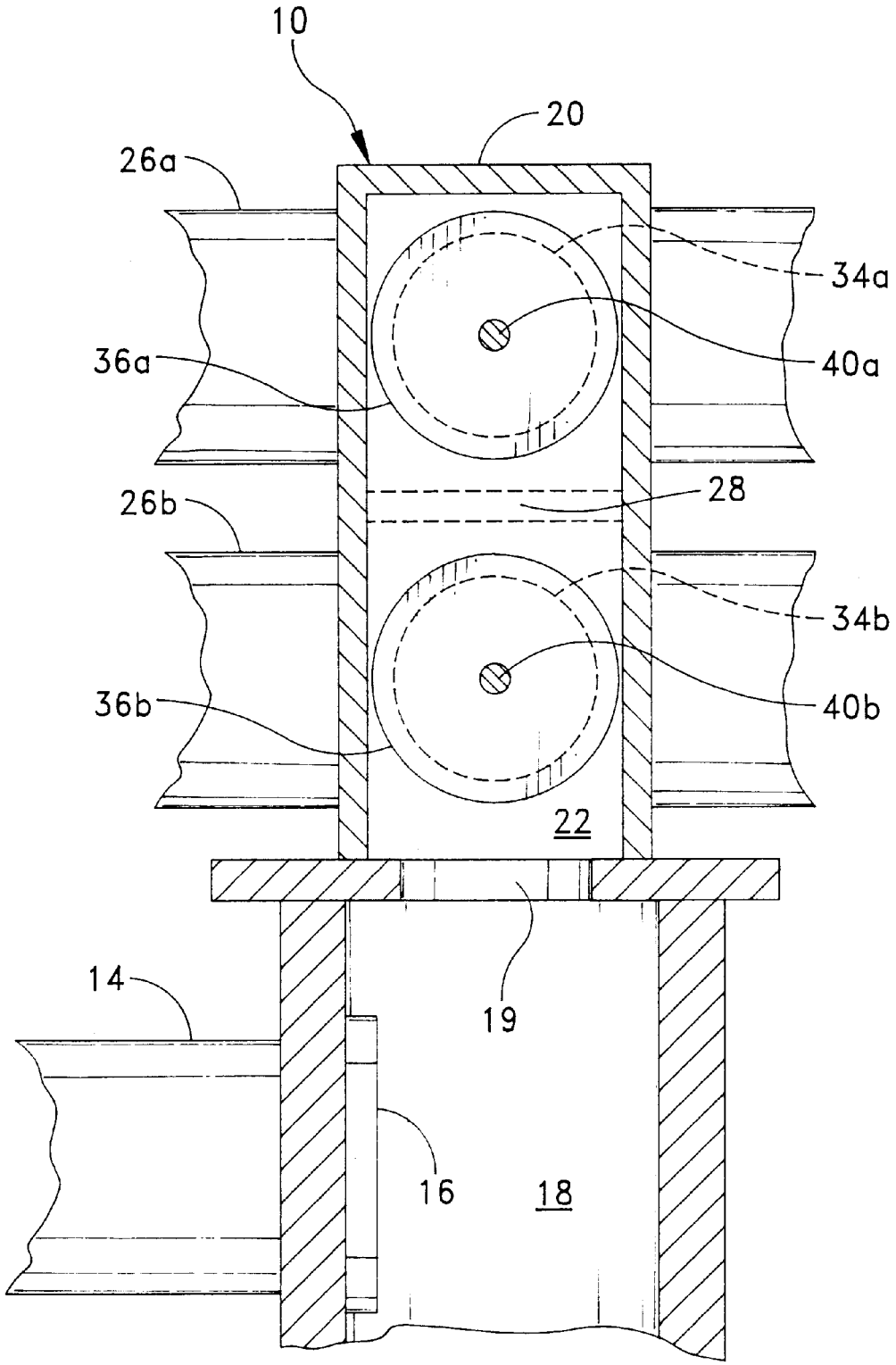
FIG. 2 is a view of the inventive tombstone assembly and associated components along the line 2—2 of FIG. 1.

Refer now to FIGS. 1 and 2 for a description of the inventive tombstone assembly 10 within a submarine's hull 12.

Seawater is initially drawn from outside a submarine's hull 12 through a water cylinder 14 by a pump 16. The pump 16 is typically either an air powered turbine or ram pump. The water passes through the pump 16 and is discharged into a large tank, named the lower impulse tank 18. The water then exits from the lower impulse tank 18 through a water passage 19, located in plate 21, into a smaller tank 20 mounted on top of the lower impulse tank 18. This smaller tank 20 is referred to as either the upper impulse tank or tombstone 20.

The tombstone 20 is a weldment divided into three integral chambers 22, 24*a*, and 24*b*. Two of the chambers, named the tube chambers 24*a*, and 24*b*, are identical and respectively surround a segment of torpedo tubes 26*a* and 26*b* that have a plurality of respective slots 27*a* and 27*b* for admitting seawater into the torpedo tubes 26*a* and 26*b*. The tube chambers 24*a* and 24*b*, are vertically stacked and separated by a horizontal plate 28. The third chamber, named the impulse chamber 22 is adjacent to the tube chambers 24*a* and 24*b*, and runs the height of the tombstone 20. It is the impulse chamber 22 that receives the water from the lower impulse tank 18 through the water passage 19.

A vertical plate 30 separates the impulse chamber 22 from the tube chambers 24*a* and 24*b*. Flow ports 34*a* and 34*b* are bored through the vertical plate 30. These flow ports 34*a* and 34*b* are each covered with respective sealed disks 36*a* and 36*b* of disk valves 39*a* and 39*b* that isolate the tube chambers 24*a* and 24*b* from the impulse chamber 22. The disks 36*a* and 36*b* have respective seals 37*a* and 37*b* that can be flat gaskets, o-rings, or any commonly used static seal. The disks 36*a* and 36*b* are driven by respective actuators 38*a* and 38*b* mounted to the outside of tombstone 20. The actuators 38*a* and 38*b* are connected to the disks 36*a* and 36*b* by respective actuator shafts 40*a* and 40*b*.

The actuators 38*a* and 38*b* are powered by any conventional means that can withstand the expected loading. The dimensions of the disks 36*a* and 36*b*, tombstone 20, and chambers 22, 24*a*, and 24*b* are selected by the flow velocity, pressure, and arrangement requirements. Material selection for the components can be any of the materials commonly used in the shipbuilding industry that will fulfill structural and corrosion resistant requirements.

Figure 3:
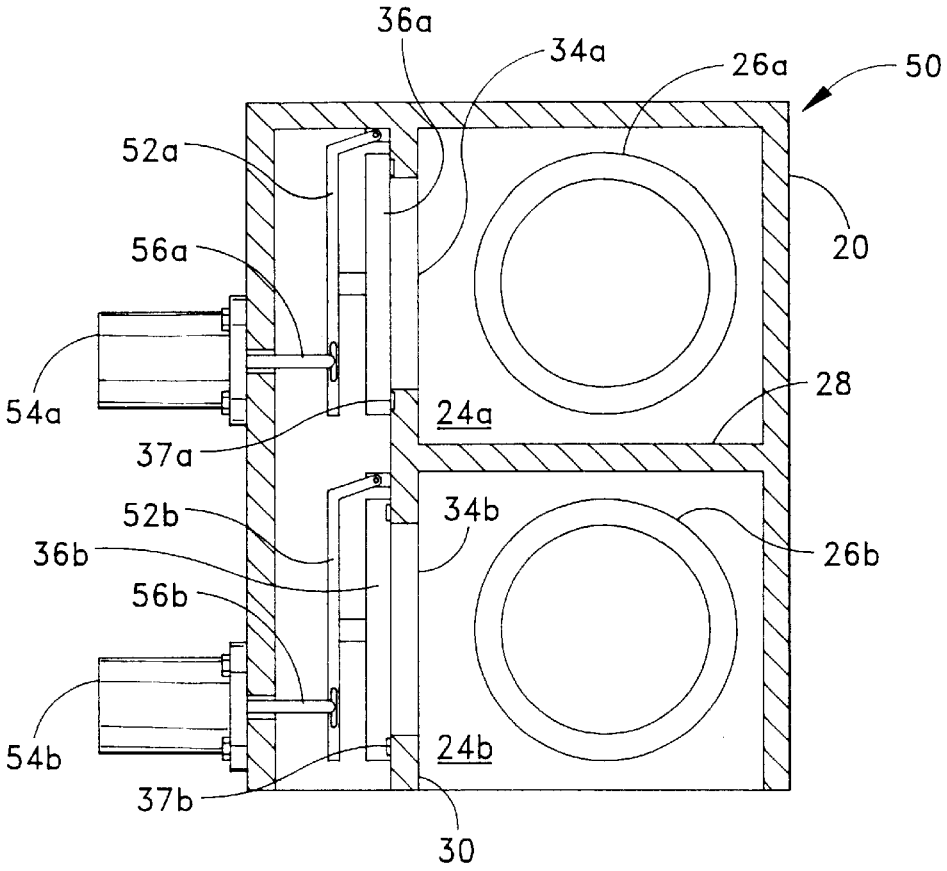
FIG. 3 is a sectional view of a first alternate embodiment of the present invention showing a hinged disk.

FIG. 3 shows a sectional view of a tombstone assembly 50. It differs from the prior arrangement in that hinge assemblies 52*a* and 52*b* are used. The arrangement shown would cause the disks 36*a* and 36*b* to have an upward swing being operated by respective actuators 54*a* and 54*b* having respective actuator shafts 56*a* and 56*b*. Actuator shafts 56*a* and 56*b* are pivotally attached to hinge assemblies 52*a* and 52*b* to allow actuators 54*a* and 54*b* to provide a lateral motion from a fixed position. The other components remain the same as in FIGS. 1 and 2.

As an alternative to FIG. 3 the hinge assemblies 52*a* and 52*b* could be rotated 90 degrees in either the clockwise or counter-clockwise direction.

Figure 4:
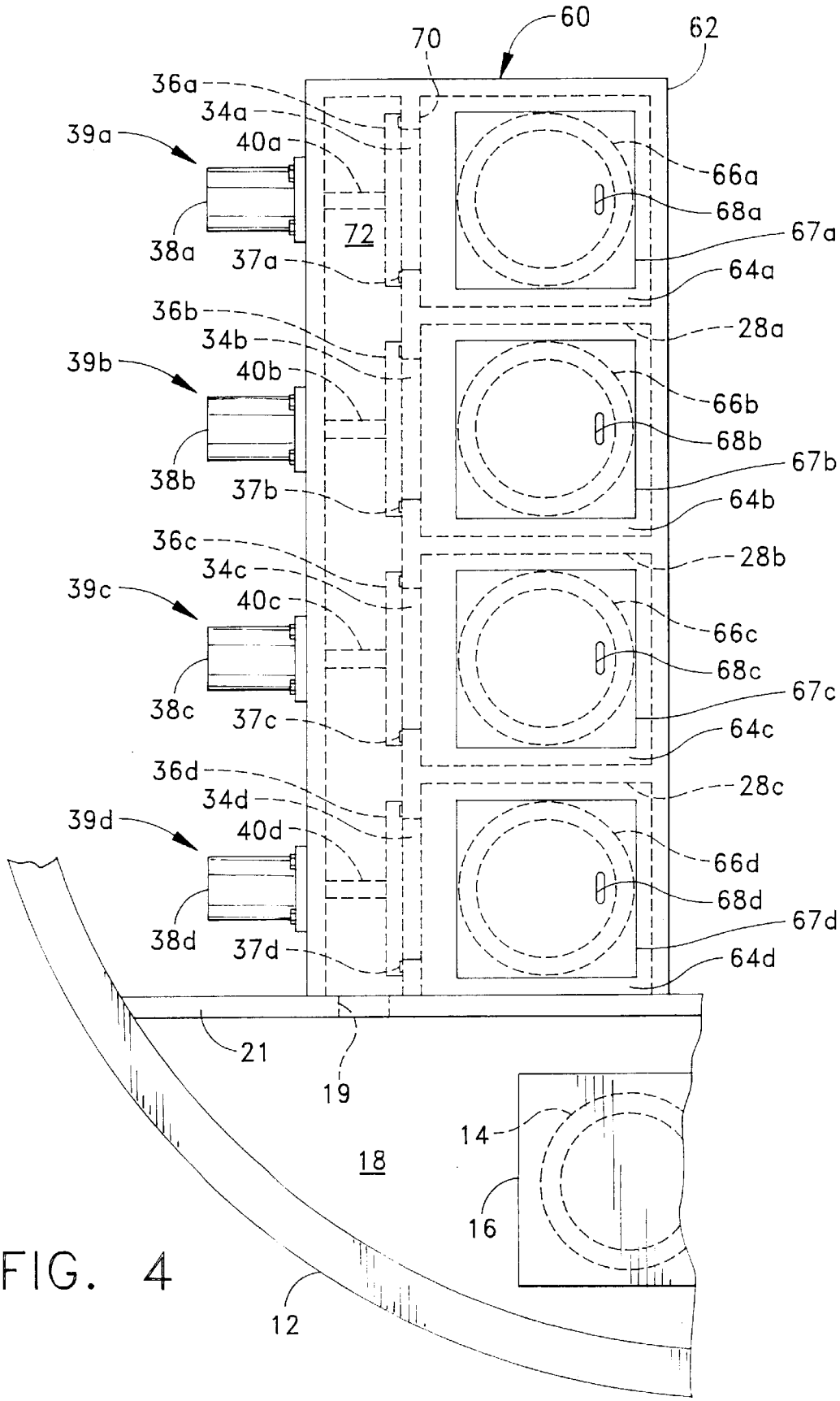
FIG. 4 is a second alternate embodiment of the present invention showing an increased number of tubes and having the tubes truncated within their respective tombstones.

FIG. 4 shows a tombstone assembly 60 having a tombstone 62 with four tube chambers 64*a*–*d* having torpedo tubes 66*a*–*d* in dashed lines as they do not penetrate the watertight doors 67*a*–*d* facing the viewer. The watertight doors 66*a*–*d* have respective handles 68*a*–*d*. The torpedo tubes 67*a*–*d* must penetrate the inner walls of tombstone 62 and end within the chambers 64*a*–*d*. In this arrangement slots are not needed for torpedo tubes 66*a*–*d* as the seawater flows into the ends of torpedo tubes 66*a*–*d*. Space must also be provided from the ends of torpedo tubes 66*a*–*d* to their respective doors 67*a*–*d* to enable this flow of seawater. The watertight doors 67*a*–*d* enable the insertion of torpedoes (not shown) into the torpedo tubes 66*a*–*d*. There are three horizontal plates 28*a*–*c*, separating the tube chambers 64*a*–*d*. Four disk valves 39*a*–*d* have actuators 38*a*–*d* with respective shafts 40*a*–*d* operate respective disks 36*a*–*d* having seals 37*a*–*d*. The remaining components shown are vertical plate 70, flow ports 34*a*–*d*, impulse chamber 72, plate 21 having a water passage 19, lower impulse tank 18, water cylinder 14, pump 16 and hull 12.

Figure 5:
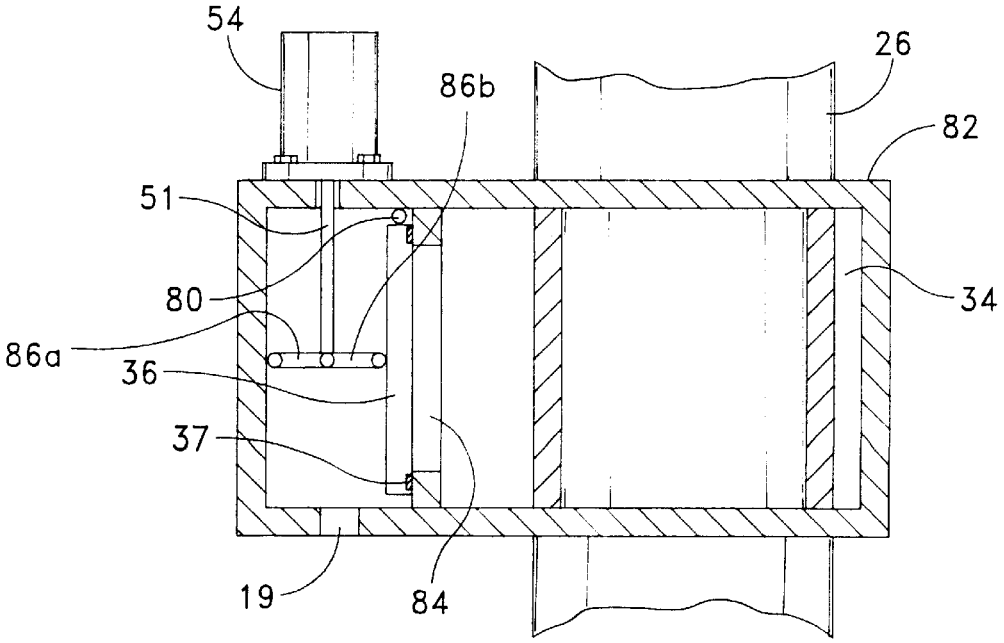
FIG. 5 is a sectional view of a third alternative embodiment showing a hinged disk with linkage.

FIG. 5 shows a sectional view of an arrangement having a disk 36 mounted on a hinge 80 within tombstone 82 having vertical wall 84 with the actuator 54 mounted on the outside wall of the tombstone 82. Link members 86*a* and 86*b* are attached together between disk 36 and an inner vertical wall of tombstone 82. Upon actuation, links 86*a* and 86*b* pivot at their joint with actuator shaft 56 thereby opening disk 36. This design reduces actuator bending and axial loads. In addition to the disk 36 swinging up and down as shown in FIG. 5, it could be assembled to have the disk 36 swing fore and aft. A torpedo tube 26, tube chamber 34, water passage 19, and a seal 37 are also shown.

There has therefore been described a tombstone assembly that has many advantages over one that utilized a conventional tube slide valve. The first being a reduction in cost. The tombstone assembly of the present invention utilizing a weldment with disk valves can be manufactured and assembled in a shop. The structure can than be moved into a submarine and welded in position. The tight tolerances of the tube inner diameter required in the slide valve location is also eliminated.

The sealing mechanism for this type of valve is a static face seal. There is no sliding motion between it and other interfacing parts. This eliminates damage to gaskets caused by entrapped particles. The disks are mounted vertically. This reduces the tendency for foreign matter to settle on the sealing surface. The static face seal has also been used on the torpedo tube muzzle, breech and water cylinder doors on past and current submarines with great success. This type of seal improves the weapon launching system reliability and reduces maintenance.

Another advantage is that the present invention provides more arrangement flexibility to shipyard designers. There is now the option to reduce or eliminate the section of torpedo tube that extends aft of the tombstone into the torpedo room. Interferences between the tube mounted actuators and other structures are also eliminated. The actuators for this invention are mounted on the outside of the tombstone between the pressure hull and the tombstone. This location is not a high traffic area and is unlikely to interfere with other equipment.

The present invention also provides the option to eliminate the tube slots. The addition of the vertical and horizontal plates inside the tombstone provides strength that reduces the flexing of the tombstone walls. An unobstructed path from the tombstone into the torpedo tube provides the maximum flow space into the tube with the least amount of obstructions.

Additional alterative arrangements include that the valve can have its flow control component in the shape of a rectangular plate or hemispherical cap as long as an adequate seal is maintained and the structural integrity is not diminished. In addition the arrangement of chambers can be modified to locate the tube chambers on the outboard side of the tombstone and the impulse chamber inboard. The actuators are then mounted on the inboard side of the tombstone. This design provides more space outboard of the tombstone.

It will be understood that various changes in the details, materials, steps and arrangement of parts, which have been herein described and illustrated in order to explain the nature of the invention, may be made by those skilled in the art within the principle and scope of the invention as expressed in the appended claims.

What is claimed is:

1. A tombstone comprising:

a tank having a plurality of outer sidewalls, a top surface, and a bottom, a vertical plate located inside the tank separating the tank into an impulse chamber compartment and a tube chamber compartment;

said impulse chamber compartment including a plurality of apertures on one of said outer sidewalls that is opposite said vertical plate for mounting purposes, said impulse chamber compartment further having an opening in the bottom;

said vertical plate including a plurality of apertures between said impulse chamber compartment and said tube chamber compartment; and said tube chamber compartment including a horizontal plate between each of said vertical plate apertures for forming a plurality of tube chambers within said tube chamber compartment.

2. A tombstone according to claim 1 wherein each of said tube chambers includes a pair of opposing apertures on two of said outer sidewalls.

3. A tombstone according to claim 1 wherein each of said tube chambers includes an aperture and a door on opposing outer side-walls.

4. A tombstone assembly comprising:

a tank having a plurality of outer sidewalls, a top surface, and a bottom, a vertical plate located inside the tank separating the tank into an impulse chamber compartment and a tube chamber compartment, said impulse chamber compartment including a plurality of apertures on the one of said outer sidewalls that is opposite said vertical plate for mounting purposes, said impulse chamber further having an opening in the bottom, said vertical plate including a plurality of apertures between said impulse chamber compartment and said tube chamber compartment, and said tube chamber compartment including a horizontal plate between each of said vertical plate apertures for forming a plurality of tube chambers within said tube chamber compartment;

a plate affixed to said tank's bottom, said plate including an aperture aligned with said opening in the bottom of said tank's impulse chamber for the admission of seawater; and a plurality of valve assemblies mounted on said impulse chamber compartment outer wall that has said plurality of apertures with each of said valve assemblies passing through one of said plurality of apertures, each of said valve assemblies having a disk operated by an actuator, said disk abutting at times said vertical plate for controlling the flow of seawater through said respective vertical plate apertures between said impulse chamber compartment and each of said tube chambers.

5. A tombstone assembly according to claim 4 further comprising a plurality of tubes with each of said tubes respectively joined to each of said tube chambers, each of said tube chambers includes a pair of opposing apertures on two of said outer sidewalls with each of said tubes passing through said opposing apertures.

6. A tombstone assembly according to claim 4 further comprising a plurality of tubes with each of said tubes respectively joined to each of said tube chambers each of said tube chambers includes an aperture and a door on opposing outer sidewalls with each of said tubes passing through a respective aperture.

7. A tombstone assembly according to claim 4 wherein each of said disks has a hinged connection to each of said respective actuators for operating each of said disks.

8. A tombstone assembly comprising:

a tank having a plurality of outer sidewalls, a top surface, and a bottom, a vertical plate located inside the tank separating the tank into an impulse chamber compartment and a tube chamber compartment, said impulse chamber compartment including an aperture on the one of said outer sidewalls that is opposite said vertical plate for mounting purposes, said impulse chamber further having an opening in the bottom, said vertical plate including an aperture between said impulse chamber compartment and said tube chamber compartment;

a plate affixed to said tank's bottom, said plate including an aperture aligned with said opening in the bottom of said tank's impulse chamber for the admission of seawater; and a valve assembly mounted on said impulse chamber compartment outer wall that has said aperture, said valve assembly passing through said outer wall aperture, said valve assembly having a disk operated by an actuator, said disk abutting at times said vertical plate for controlling the flow of seawater through said vertical plate aperture between said impulse chamber compartment and said tube chamber compartment.

9. A tombstone assembly according to claim 8 further comprising a tube joined in said tube chamber compartment, and said tube chamber compartment including a pair of opposing apertures on two of said outer sidewalls with said tube passing through said opposing apertures.

10. A tombstone assembly according to claim 8 further comprising a tube joined in said tube chamber compartment, and said tube chamber compartment including an aperture and a door on opposing outer sidewalls with said tube passing through said aperture.

11. A tombstone assembly according to claim 8 wherein said disk has a hinged connection to said actuator for operating said disk.

* * * * *